United States Patent [19]

Moog

[11] Patent Number: 4,696,371

[45] Date of Patent: Sep. 29, 1987

[54] BRIDGE BOTTOM INSPECTION APPARATUS

[76] Inventor: Alfons Moog, Untersiggingen 100, 7774 Deggenhausertal 3, Fed. Rep. of Germany

[21] Appl. No.: 714,016

[22] Filed: Mar. 19, 1985

[30] Foreign Application Priority Data

Mar. 24, 1984 [DE] Fed. Rep. of Germany ..... 3410952

[51] Int. Cl.[4] ..... E04G 3/10

[52] U.S. Cl. ..... 182/63; 182/62.5

[58] Field of Search ..... 182/63, 62.5, 64, 65, 182/68, 2; 212/199, 203, 211

[56] References Cited

U.S. PATENT DOCUMENTS

| | | | |
|---|---|---|---|
| 3,301,416 | 1/1967 | Bopp | 212/199 |
| 3,357,517 | 12/1967 | Wagner . | |
| 3,608,669 | 9/1971 | Lindsay . | |
| 4,074,790 | 2/1978 | Colbachini | 182/63 |

FOREIGN PATENT DOCUMENTS

| | | | |
|---|---|---|---|
| 213946 | 2/1961 | Austria . | |
| 220657 | 9/1961 | Austria . | |
| 1100068 | 2/1961 | Fed. Rep. of Germany . | |
| 2235611 | 1/1974 | Fed. Rep. of Germany | 212/199 |
| 2552191 | 5/1976 | Fed. Rep. of Germany . | |
| 3124183 | 12/1982 | Fed. Rep. of Germany . | |
| 8225810 | 3/1983 | Fed. Rep. of Germany . | |
| 8337221 | 2/1984 | Fed. Rep. of Germany . | |
| 8325671 | 3/1984 | Fed. Rep. of Germany . | |
| 3305384 | 3/1984 | Fed. Rep. of Germany . | |
| 8323628 | 4/1984 | Fed. Rep. of Germany . | |
| 63533 | 9/1955 | France | 212/199 |
| 2292074 | 11/1975 | France . | |
| 2290535 | 6/1976 | France . | |
| 771589 | 12/1960 | U.S.S.R. | 212/199 |
| 444853 | 11/1984 | U.S.S.R. | 182/63 |

OTHER PUBLICATIONS

H. G. Jacobi, "Die Strassenbrücke über das Alzettetal in Luxemburg", [The Street Bridge over the Alzettetal in Luxemburg], *Der Stahlbau* [Steel Construction], vol. 7/1969, pp. 198–199.

"Cramer Mobil-Lifte" advertisement, 1981, 4 pages.

"Der professionelle Mietpark für alle Brücken-Verantwortlichen" advertisement, available 1983, 4 pages.

"Betomax" catalog, 1980, pp. 27 and 28.

*Primary Examiner*—Reinaldo P. Machado
*Assistant Examiner*—Alvin Chin-Shue
*Attorney, Agent, or Firm*—Spencer & Frank

[57] ABSTRACT

The invention relates to a bridge bottom inspection apparatus which includes an operating chassis movable along the edge of the bridge. A lift tower (6) is raisably and lowerably supported by chassis and can extended downwards past the edge of the bridge. A work platform (5 ) is attached to the lift tower and can be cantilevered beneath the bridge. In order to permit the apparatus to be erected simply, to reduce its overall weight and therefore the load upon the bridge, and to overcome high sound insulation walls located in the guard rail region, the operating chassis has a guide tower (8) located on the bridge, on which the lift tower (6) is guided for up and down movement by means of cantilevered support elements (10). The operating chassis may be a rail or transport vehicle (1). The guide tower (8) is mounted on a turntable (3) of the vehicle pivotably about a horizontal axis (9). Particular further developments of the bridge bottom inspection apparatus described serve to permit it to be moved past masts arranged at the edge of the bridge in such a manner that the lift tower (6) and the work platform (5) can remain in their work position.

17 Claims, 12 Drawing Figures

1
2
3
4
5+6
6
7
8
9
10
11
12
13
14
15
18
20
22
23
24
25
26
27
28
29
31
32
36
38

BRIDGE BOTTOM INSPECTION APPARATUS

BACKGROUND OF THE INVENTION

The invention relates to a bridge bottom inspection apparatus with an operating chassis standing on the bridge and movable along the edge of the bridge and with a raisable and lowerable lift tower retained and supported by the latter which extends downwards past the edge of the bridge and to the lower end of which a work platform cantilevered beneath the bridge is attached. Such apparatuses are used instead of scaffolds or vertical lifts for the inspection or cleaning, particularly of concrete bridges, in order to reach the underside of the bridge.

Known bridge bottom inspection apparatuses, according to German Offenlegungsschrift No. 3,305,384, for example, have a box-like annular construction surrounding the lift tower, which projects from the operating chassis over the edge of the bridge and retains the lift tower and guides it in its ascending and descending movement. It is accordingly necessary for the lift tower to be of particularly flexurally rigid construction along its total length, and therefore heavy. The lifting drive unit, generally a hydraulic cylinder, is arranged in the lift tower. However, since it is necessary, for considerations of stability, for those parts of the operating chassis located on the bridge to correspond as counter weight to the parts located outside the bridge, this known construction is comparatively heavy.

Many bridges of motorways which lead through residential areas have sound insulation walls up to 3.5 m in height above or in place of the guard rail. The use of the known bridge bottom inspection apparatuses necessitates the dismantling of these sound insulation walls.

In the case of other bridges, the use of known bridge bottom inspection devices is obstructed by the fact that masts, for highway lighting or for the overhead electric lines of trolleybuses or railways, for example, are installed at comparatively short intervals along the edge of the bridge. It is necessary for the work platform and the lift tower to be retracted onto the bridge surface in front of each such obstacle to permit the operating chassis to be transported past the mast.

SUMMARY OF THE INVENTION

The underlying object of the invention is to develop a light bridge bottom inspection apparatus which imposes a smaller weight upon the cap region (cantilevered edge region) of the bridge and which also permits high sound insulation walls extending along the edge of the bridge to be overcome. A further object of the invention is to disclose a construction which permits the bridge bottom inspection apparatus to be taken past masts in such a way that the work platform and the tower can remain in their work positions.

It is proposed according to the invention that the operating chassis has a guide tower located on the inside of the edge barrier of the bridge and that the lift tower is guided with upward and downward mobility on the guide tower by means of support elements overhanging the edge barrier.

The guide tower is located on the bridge inside the edge barrier, the bridge guard rail for example, so that its weight generates no outward tilting moment . I-profile rails, which are of significant weight, are preferably used for guidance. In addition, the hydraulic cylinder, generally extremely heavy, for the lifting drive unit can be arranged on the guide tower and therefore on the bridge. The lift tower may be so long (high) that, in the operating position (work platform pivoted beneath the bridge) the lowest support elements engage above the sound insulation wall, so that the latter forms no obstacle during useful work. A floor may be provided in the region of the support elements, so that the access to the work platform can easily be made upwards through the guide tower, across this floor and downwards through the lift tower. Lastly, the lift tower can also be dimensioned lighter for another reason, because the forces are introduced through the support elements, not in varying positions, but in the same position.

The erection of the bridge bottom inspection apparatus may be effected by means of a crane. However, in order to make crane assistance unnecessary and to render the apparatus self-erecting and to facilitate the transport to the bridge, it is proposed that the operating chassis is constructed as a transport vehicle suitable for the transport of the entire bridge bottom inspection apparatus, and has a turntable rotatable about a vertical axis, on which the guide tower is mounted pivotably about a horizontal axis extending in the longitudinal direction of the bridge in the operating position.

The transport vehicle in the case of road transport may be a trailer or a truck, which is positioned in the longitudinal direction near the edge of the bridge in either case. In the case of railway bridges on the other hand, it is advantageous to erect the entire apparatus on a rail-travelling wagon. Railway wagons can be extremely heavy, 60 tonnes for example, so that the stability of the apparatus is ensured. Railway bridges are also generally narrow.

In order to enlarge the standing surface of these vehicles and to prevent vibrations of the work platform due to the suspension of the vehicle, the turntable may be equipped with bracing rollers lowerable onto the bridge surface and running in the longitudinal direction of the bridge. However, instead of the turntable the chassis of the transport vehicle may also have transverse jibs provided with corresponding bracing rollers. These jibs, may, as customary, be of vertically adjustable or hingeable construction and be arranged on both sides of the vehicle.

A further improvement of this construction lies in the fact that the turntable is arranged on a transverse carriage movable horizontally relative to the vehicle chassis and transversely to the direction of travel. By this means the bridge bottom inspection apparatus can be adjusted accurately relative to the edge of the bridge in the transverse direction of the bridge without complicated maneuvering of the transport vehicle. The varying interval of guard rails, guide planks or the like from the edge of the bridge can be taken into consideration by this means. The transverse carriage will be placed in a stable guide means and driven by means of a hydraulic cylinder. The adjustment range may be, for example, 0.5 m to both sides.

In the case of narrow bridges, particularly if guide planks are provided at an interval from the edge of the bridge, so that the transport vehicle cannot be driven quite up to the edge of the bridge, the transport vehicle obstructs the traffic. In such cases a special operating chassis is to be preferred, the wheels of which run partly in front of and partly behind the guide planks, and also a particular road transport vehicle. However, the empty road transport vehicle must be driven away after the erection of the bridge bottom inspection apparatus in order to clear the lane for the traffic. This requires time and personnel. Also the vehicle is not available as a counterweight.

It is proposed as a special construction that the guide tower is mounted on the operating chassis pivotably about a horizontal axis and has on its lower side, referred to the horizontal transport position, a turntable which is connected rotatably to a transport chassis, the turntable axis extending at right angles to the guide tower and at right angles to the standing surface of the transport chassis. The transport chassis may be particularly a four-wheeled trailer. The solution of the problem therefore lies in the fact that the transport chassis is raised from the highway by pivoting upwards and is thereby removed totally from the traffic space. It hangs from the guide tower tilted through 90° and develops its effect as a counterweight. Further details of this will emerge from the description of an exemplary embodiment.

Another doctrine of the invention makes it possible to overcome without difficulty masts standing at the edge of the bridge on the normal track of the apparatus leading along the edge of the bridge, witnout the need to raise the work platform. The following doctrine possesses far-reaching significance by the fact that it is not restricted to bridge bottom inspection apparatuses with a raisable and lowerable so-called lift tower, but is also suitable for rigid apparatuses with a beam or tower extending downwards from the operating chassis. It is proposed that, in order to connect the operating chassis to the tower, a plurality of support elements are arranged on the operating chassis at a mutual interval in the longitudinal direction of the bridge, which can selectively be individually separated from the tower and retracted to the operating chassis, a safety control device being provided which prevents the simultaneous actuation of all the support elements and the separation of further support elements so long as the remaining support elements are separated. In operation, therefore, in principle the particular support element which would strike the mast first is separated. Then the operating chassis is moved onwards until the mast stands just in front of the next support element. Now the first support element released is coupled again and the next one released, and so on. Various embodiments of this invention with a varying number of support elements and varying movement rhythm are possible.

For a bridge bottom inspection apparatus with guide tower and lift tower, it is proposed in order to overcome masts at the edge of the bridge, that there is provided on the guide tower a sliding stage movable up and down, to which cantilevered support arms are attached as first support elements, and that as second support elements, two pivot arms are mounted pivotably about vertical axes on a non-raisable part of the operating chassis, the support arms, the pivot arms and the lift tower having, for their mutual connection, coupling parts to be moved into and out of engagement in the vertical direction. This proposal is described in all its details. Four support arms with hooks are provided on the sliding stage, and two pivot arms, each with two hooks, on the turntable, that is to say on the base of the guide tower. One advantage of this solution is that the lift tower drops by its weight into the coupling elements each time and reliable coupling is thereby possible. The vertical mobility of the sliding stage is utilised for coupling.

Another preferred embodiment, likewise with a sliding stage movable up and down on the guide tower, consists in the arrangement on the sliding stage, as support elements, of three parallelogram frames which each have a plurality of arms arranged superposed and pivotable up and down, which are mutually connected by a vertically arranged articulated strap and actuable by means of a pivoting drive unit, and in connecting the arms to the lift tower by means of plug-in coupling parts. In this case the pivot arms of one at a time of the three frame planes can be released without endangering the stability. The coupling operation is effected here by means of the pivoting drive unit. The arms are coupled to the lift tower in the horizontal position and released in the downwardly pivoted position. They then respectively make space for traveling past the mast. This construction also has the advantage that the interval between the lift tower and the guide tower can be varied, if so desired, by the common inclination of all the pivot arms. This may be significant, particularly during road transport, because it is possible in this manner to reduce the overall height of the bridge bottom inspection apparatus loaded ready for transport.

Lastly, with a view to overcoming bridge masts, it is proposed as a third embodiment that, as support elements, two pivot frames, each of which alone can support the lift tower, are mounted pivotably about vertical axes on the sliding stage of the guide tower. The actuation of such an apparatus is simpler because the operating chassis need stop only once in order to couple the one pivot frame and to release the other. The direction of movement of the coupling elements is horizontal. It may therefore be advantageous, for ease of introduction and locking of the coupling elements, to give the coupling elements on at least one pivot frame a limited vertical adjustability, for example, driven by short hydraulic cylinders.

BRIEF DESCRIPTION OF THE DRAWINGS

Exemplary embodiments of the invention are explained more fully below with reference to the drawing, in which specifically.

DESCRIPTIONS OF THE PREFERRED EMBODIMENTS

Figures 1, 6, 7:
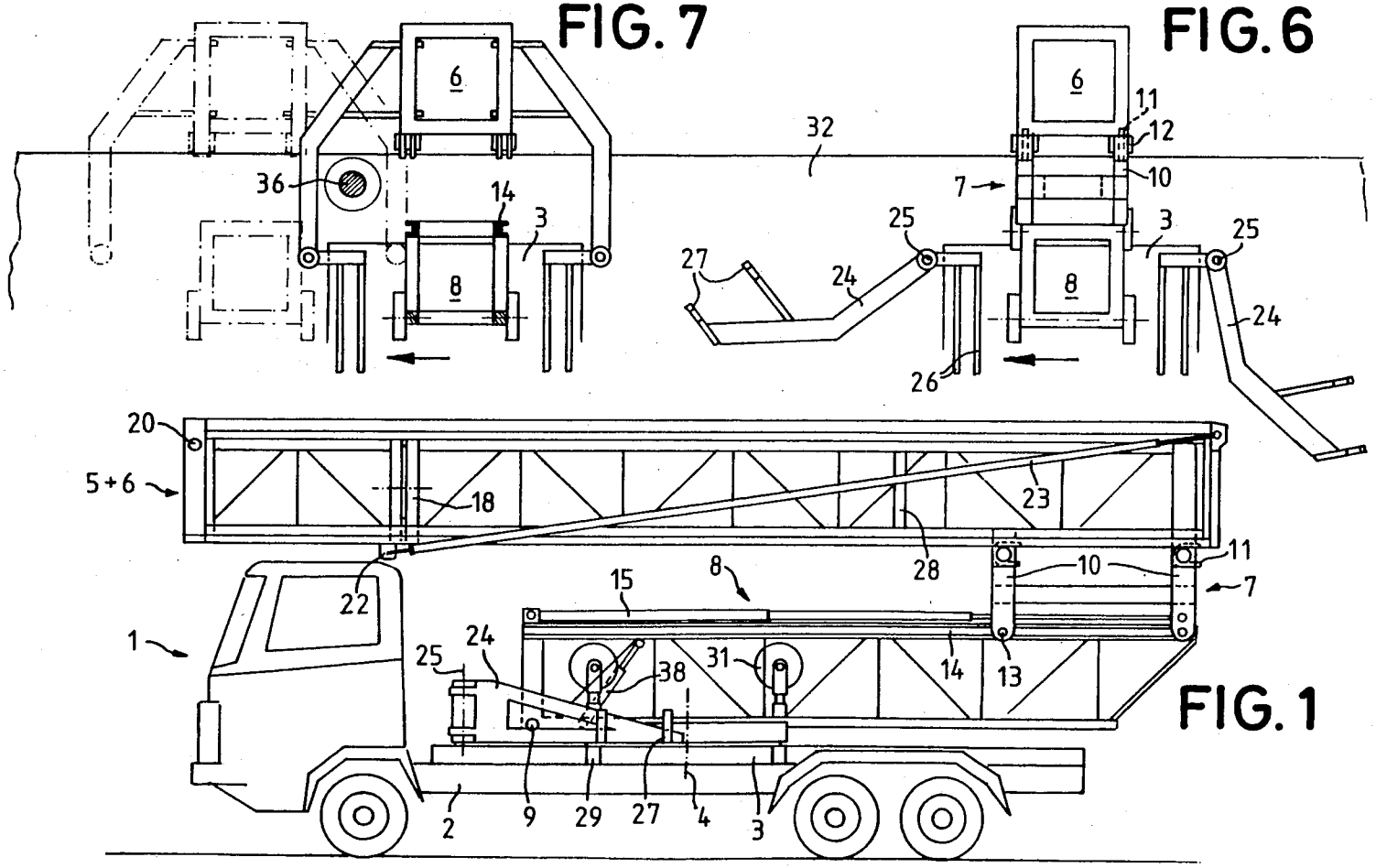
FIG. 1 shows the side elevation of a bridge bottom inspection apparatus in the transport state.
FIG. 6 shows parts of the bridge bottom inspection apparatus in the position according to FIG. 4, in plan.
FIG. 7 shows parts of the bridge bottom inspection apparatus in the position according to FIG. 5, in plan.

The bridge bottom inspection apparatus according to FIGS. 1 to 7 employs a three-axled truck 1 as a combined operating chassis and transport chassis. Its chassis 2 carries a turntable 3, the axis of rotation of which is designated 4. A lift tower 6, surrounded at the top and at the sides by a work platform 5, is connected to a guide tower 8 by means of a sliding stage 7. This guide tower 8 is articulated to the turntable 3 with upward pivoting mobility about a horizontal axis 9. The towers and the work platform consist of a lattice construction, of aluminum for example.

The sliding stage 7 consists of four rigidly mutually connected support arms 10, the gripping hooks 11 (FIG. 5) of which engage into corresponding hook eyes 12 on the lift tower 6. On the other side the sliding stage 7 is guided movably by means of rollers 13 in two I-profile rails 14 of the guide tower 8. The drive unit is formed by a hydraulic telescopic cylinder 15 attached to the guide tower externally. A transport stay, not shown, which is removed in the operating state, braces the lift tower 6 relative to the guide tower 8 on the truck 1.

The lift tower 6 is divided into an upper part 16 and a lower part 17, which are mutually connected by a ring mount 18, the axis of which is aligned with the tower axis. The drive unit of the ring mount is not shown. The work platform 5 consists of a main paltform 19, which is articulated to the lower part 17 of the lift tower pivotably about an axis 20, and of an auxiliary platform 21 which can be telescoped in the longitudinal direction. From straps 22 attached to the lower part 17, two hydraulic cylinders prolonged by tubes 23 extend to the end of the main platform 19. Both the platforms have a U-shaped cross-section and therefore enclose the lift tower 6 in the folded state.

The bridge bottom inspection apparatus further comprises two triangular bent pivot arms 24 (FIG. 6), which are articulated to the turntable 3 pivotably about vertical axes 25. The axes of rotation are formed by stable hinges stiffened by triangular bracing walls 26. Two gripping hooks 27, which can grip the lift tower 6 by lateral transverse spars 28, are arranged on each of the pivot arms 24.

Improved bracing of the pivoted turntable 3 is provided by two jib rails 29 (FIG. 3) which can be drawn out laterally from the chassis 2, and to which bracing legs 30 are hingeably articulated. The bracing legs are provided with bracing rollers 31, which run parallel to the truck 1. A dead-slow drive unit for the progress of the erected apparatus along the bridge may be installed in the truck or influence the bracing rollers 31.

Figure 2:
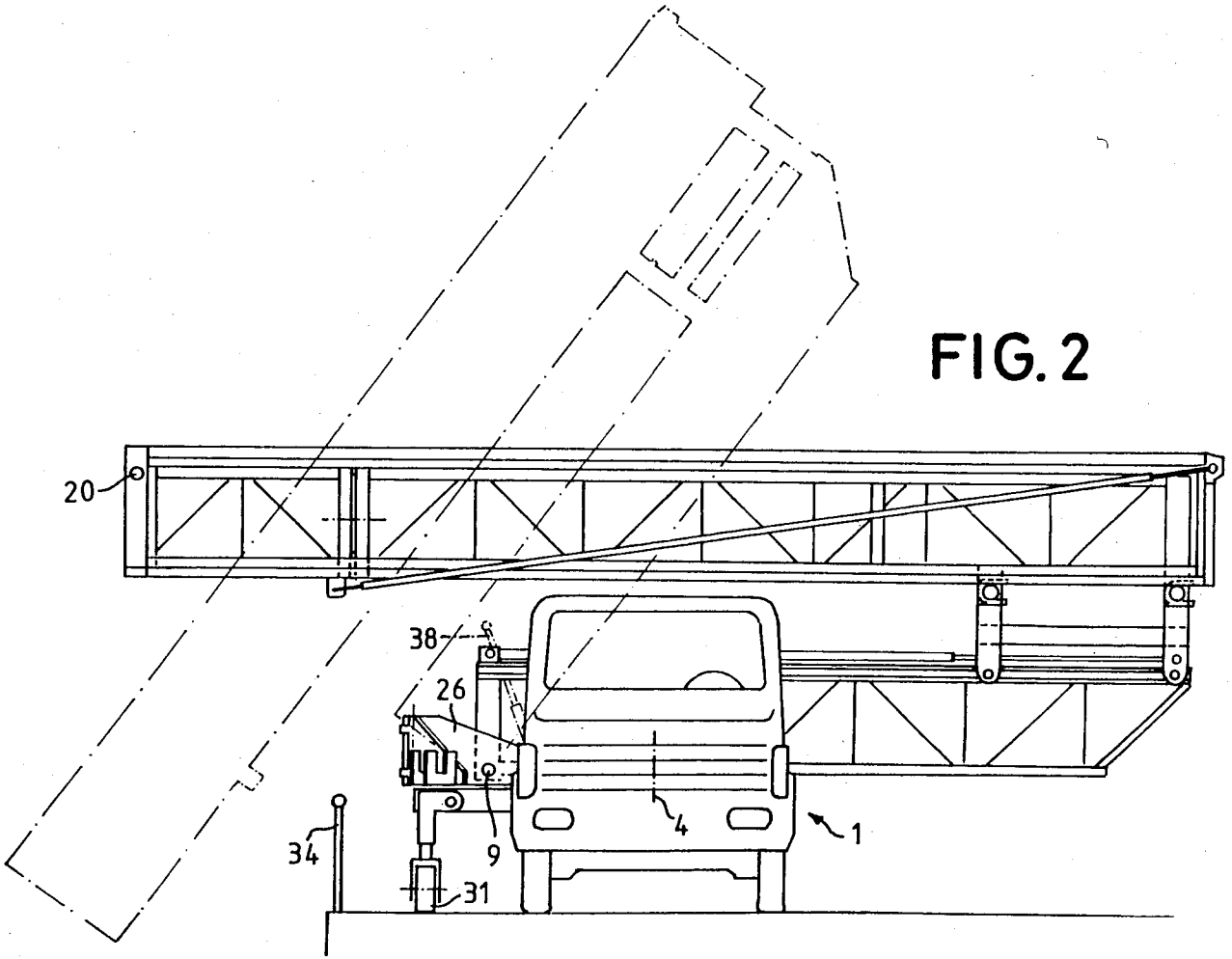
FIG. 2 shows the apparatus according to FIG. 1 after executing a 90° rotation of the turntable, viewed in the direction of travel and in the longitudinal direction of the bridge.
Figure 3:
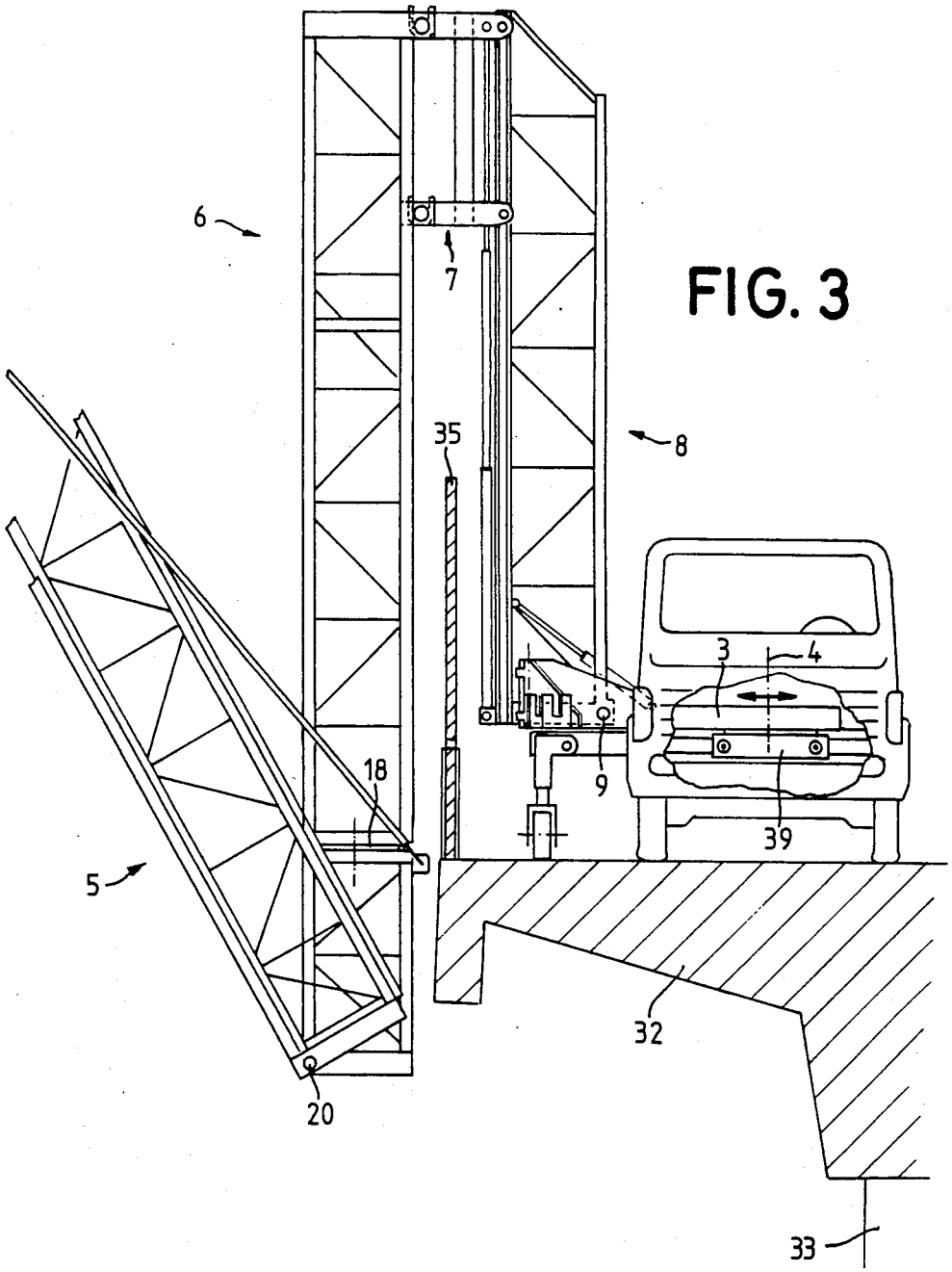
FIG. 3 shows a view of the apparatus as in FIG. 2, in a further state of erection.
Figure 4:
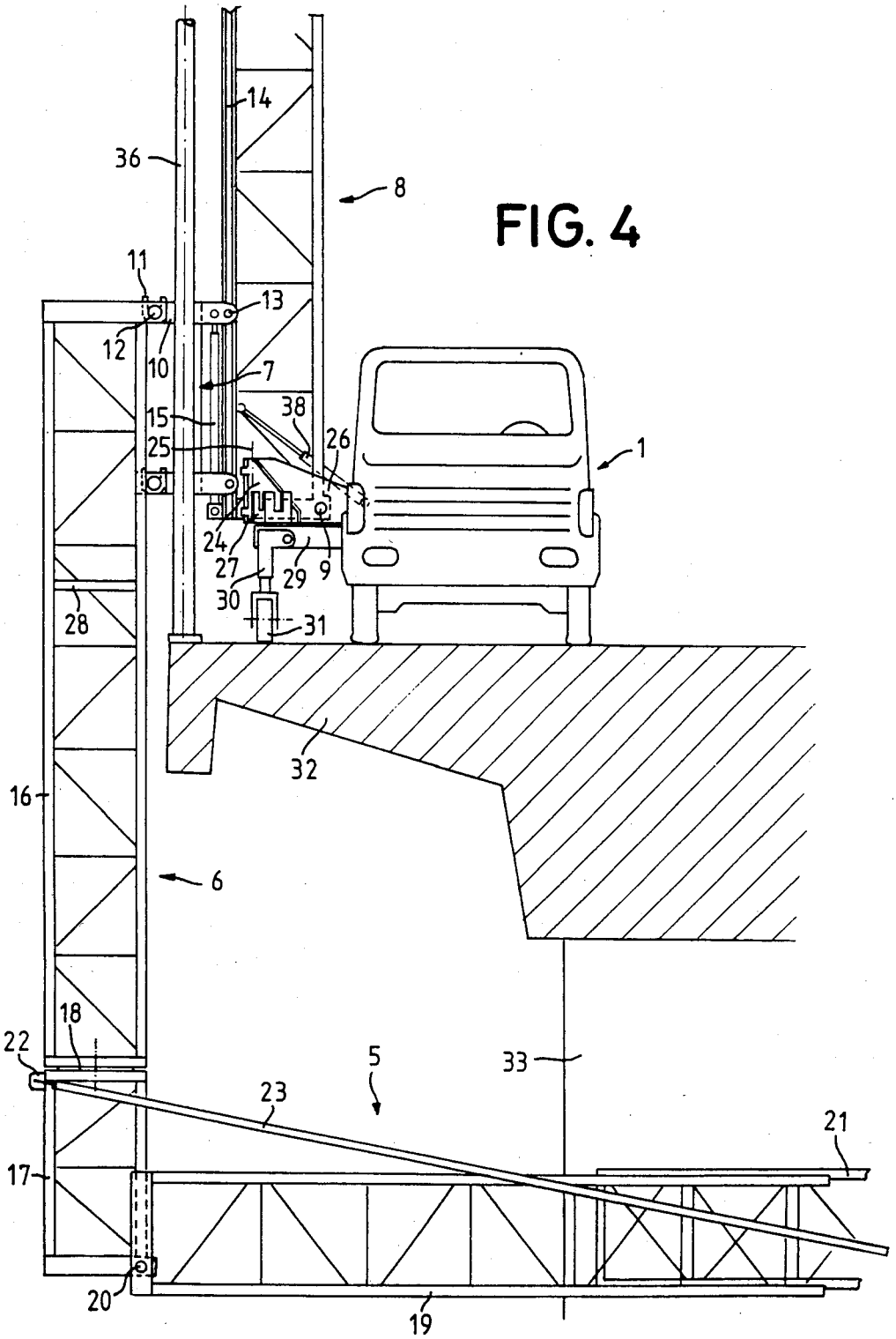
FIG. 4 shows a view of the apparatus as in FIG. 2 in the work position.

FIGS. 3 and 4 show the so-called cap region of a bridge 32 in cross-section. A bridge pier 33 is indicated. As examples of edge barriers, a guard rail 34 is shown in FIG. 2 and a sound insulation wall 35 in FIG. 3. On the other hand, a mast 36, which carries a lamp housing 37 for the road lighting, is illustrated in the same position in FIGS. 4 and 5. It will be explained with reference to FIGS. 6 and 7, how the bridge bottom inspection apparatus in the erected state can travel past such masts.

It is indicated in FIG. 3 that the turntable 3 can be mounted on a transverse carriage 39, which can be adjusted within the width of the vehicle by means of a hydraulic cylinder. The axis of the turntable 3, the turntable itself and all the further superstructures are therefore, however, precisely adjustable towards the edge of the bridge relative to the truck 1.

The erection of the bridge bottom inspection apparatus proceeds as follows: the truck 1 in the transport state according to FIG. 1 travels parallel up to the edge of the bridge. First of all the bracing rollers 31 are moved into position between the truck and the edge barrier. The jib rails 29 now serve as bracing means for the turntable 3, which is rotated through 90° into the position according to FIG. 2. By means of two hydraulic drive cylinders 38, which are articulated to the turntable 3 on the one hand and to the guide tower 8 on the other hand, the guide tower with all its annexed structures and superstructures is pivoted upwards relative to the turntable about the pivot axis 9. This phase of the erection must be effected at a point of the bridge where the edge barrier is not too high. In order to keep the pivoting moment at the start of the movement within limits, the lift tower 6 with the work platform 5 may be moved on the guide tower some distance beyond the edge of the bridge. An intermediate position with an inclination of approximately 45° is indicated by chain-dotted lines in FIG. 2.

FIG. 3 shows the position of the bridge bottom inspection apparatus viewed from the same direction as in FIG. 2, after the erection of the guide tower 8. The lift tower 6 is retained on the guide tower outside the edge of the bridge and can now be lowered. Any existing transverse inclination of the bridge is advantageously compensated by dimensioning the pivoting angle of the guide tower 8 to somewhat more or less than 90°. As a further step during erection, the work platform 5 is hinged downwards, namely by extending the lift cylinders installed in the tubes 23. FIG. 3 shows the work platform in an inclined position. Possibly simultaneously with the pivoting movement of the work platform 5 the lift tower 6 is lowered by retracting the telescopic cylinder 15, and the lower part 17 of the lift tower together with the work platform is rotated through 180° at the ring mount 18. This causes the work platform 5 to pivot beneath the bridge, as shown in FIG. 4. Depending upon the width of the bridge, the auxiliary platform 21 may be extended to the right. In order to travel round the bridge piers 33, the work platform is pivoted out parallel to the bridge and back behind the pier by means of the ring mount 18.

In the present example, the possible height of the sound insulation wall 35 will be a function of the height of the bridge box. Lower bridge boxes permit higher sound insulation walls and vice versa. The working height between the floor of the work platform 5 and the bottom surface of the bridge box can be adjusted as desired at the telescopic cylinder 15. The apparatus has a high load capacity; the weight of the guide tower 8 and of the truck 1 ensure that no dangerous tilting moments occur, even when the work platform is pivoted outwards in the erection phase (FIG. 3).

The following description of the function of those parts of the bridge bottom inspection apparatus which permit traveling past masts refers particularly to FIGS. 4 to 7. Starting from FIG. 4 and the associated plan according to FIG. 6, the apparatus moves in the direction of the arrow along the edge of the bridge towards the masts 36 (FIG. 7). The lift tower 6 and the guide tower 8 are mutually connected by the sliding stage 7. The lift tower is suspended in the four gripping hooks 11 of the support arms 10. The two pivot arms 24 are hinged forwards out of the transport position into a median stand-by position, but only so far that at least the left-hand pivot arm does not obstruct the approach to the mast 36.

Figure 5:
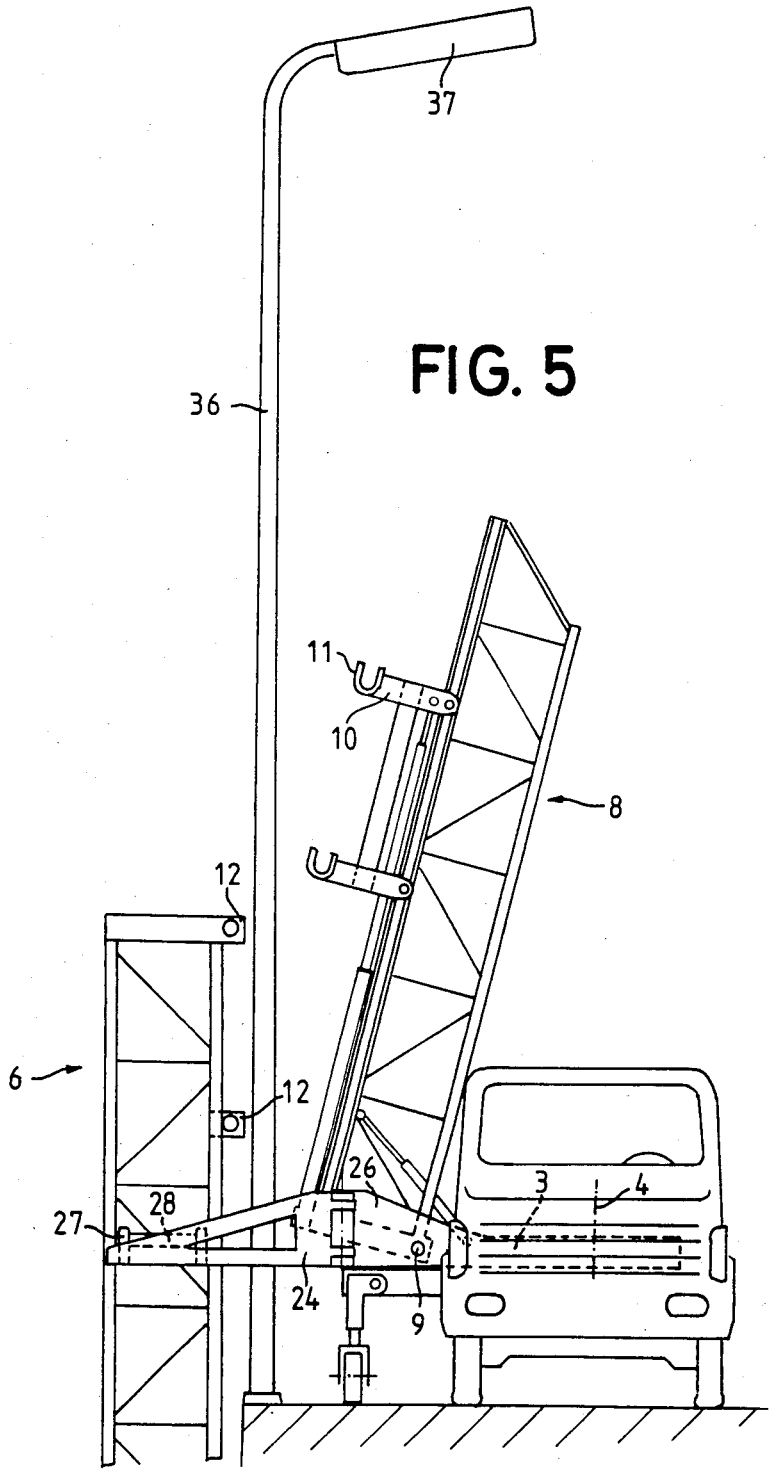
FIG. 5 shows a further view as in FIG. 2 with the guide tower pivoted back when passing a mast.

The apparatus moves in this way as far as the position shown by solid lines in FIG. 7. The mast is now located immediately in front of the sliding stage 7. In this position the traveling drive unit stops and the lift tower 6 is raised so far that the pivot arms 24 can engage with their gripping hooks 27 from the side beneath the transverse spar 28 of the lift tower. This position of the pivot arms is shown in FIGS. 5 and 7. The lift tower is now lowered slightly again by means of the sliding stage, so that the gripping hooks 27 come into engagement with the transverse spars and the pivot arms assume the full weight of the lift tower 6 and of the work platform 5. However, the sliding stage 7 continues to move downwards, so that its gripping hooks 11 are released from the hook eyes 12. The guide tower 8 is now inclined slightly backwards, as shown in FIG. 5, and in this position the sliding stage 7 can be moved higher, the lower support arms 10 with their gripping hooks moving past the lower hook eyes 12.

The support arms 10 of the sliding stage now no longer present an obstacle for onward travel, so that the apparatus can be moved into the position shown by chain-dotted lines in FIG. 7. The mast is now located beyond the two towers, but still within the space enclosed by the pivot arms 24. In this position the sliding stage 7 is lowered again, the guide tower 8 is moved into the vertical and the sliding stage is coupled to the lift tower 6 again by a fresh ascent. The lift tower is also raised a short distance, so that the transverse spars 28 are released again from the gripping hooks 27 and the two pivot arms 24 can be hinged back into the position according to FIG. 6 or the transport position.

The pivot arms 24 are preferably actuated by means of hydraulic lift cylinders, not shown. A hydraulic or electric safety control device ensures the cycle of the coupling and uncoupling operations in the manner described. It is particularly ensured that the two pivot arms can be actuated only conjointly, and only for a specific vertical position of the lift tower, in which the transverse spars 28 are located just above the gripping hooks 27. Otherwise any malfunction is excluded by the very fact that the lift tower 6 can be uncoupled from the sliding stage 7 only by resting upon the pivot arms 24. Conversely, a release of the pivot arms is only possible when the lift tower 6 is suspended in the gripping hooks 11 of the sliding stage.

Figure 8:
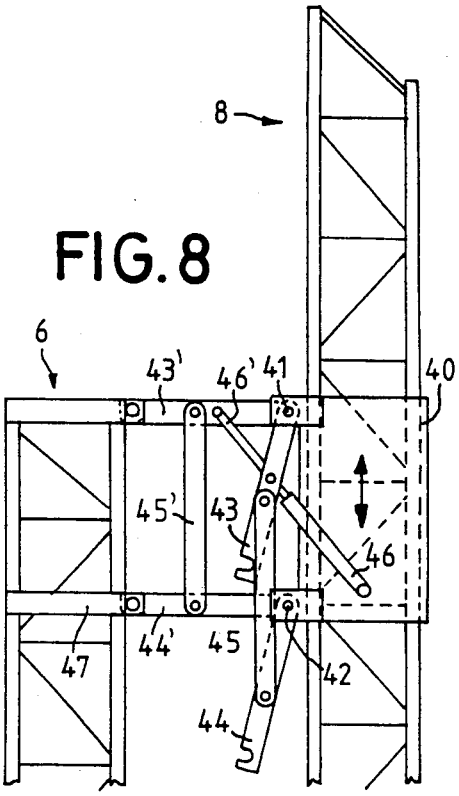
FIGS. 8 and 9 show another embodiment of the support elements connecting the lift tower and the guide tower in elevation and in plan.
Figure 9:
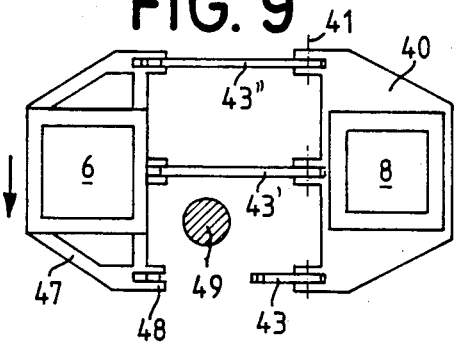

Another construction for traveling past a mast is represented in FIGS. 8 and 9. Here the sliding stage has the form of a sliding sleeve 40 surrounding the guide tower 8 with lateral extensions. On this sliding sleeve, three parallelogram frames are arranged mutually staggered parallel in the longitudinal direction of the bridge, facing the lift tower 6. Each consists of two arms 43 and 44 mounted pivotably about horizontal axes 41 and 42, which are mutually connected by a vertical articulated strap 45. Each parallelogram frame is transferable, by means of a lift cylinder 46 engaging the upper arm, between a supporting position with arms extended horizontally and a rest position with arms inclined downwards.

On the other hand, the lift tower 6 has brackets 47 cantilevered sideways, which permit a total of six hook eyes 48 to be arranged in pairs at such mutual intervals in the longitudinal direction of the bridge that they can cooperate with the hooks provided on the arms of the parallelogram frames. In terms of strength the arrangement is made such that two parallelogram frames, that is to say four arms, can support the lift tower 6 and absorb all the moments which occur.

As FIG. 9 indicates, the apparatus moves past the mast, here designated 49, by alternate lowering of the parallelogram frames. If the movement is executed in the direction of the arrow, then the arms 43, 44 are lowered first of all and the apparatus is moved until the mast is located in the first "chamber". After coupling the arms 43 and 44, the arms 43' and 44' are lowered. The apparatus is now moved onwards until the mast 49 is located in the second "chamber". After recoupling the arms 43' and 44', the arms 43'' and 44'' are uncoupled, whereby the obstacle is overcome and, finally, these last arms may also be coupled again as a safety measure. By means of automatic safety control devices, it is again possible here to ensure the correct function and prevent the release of the hooks out of the hook eyes during the erection and dismantling of the apparatus and during transport.

Figure 10:
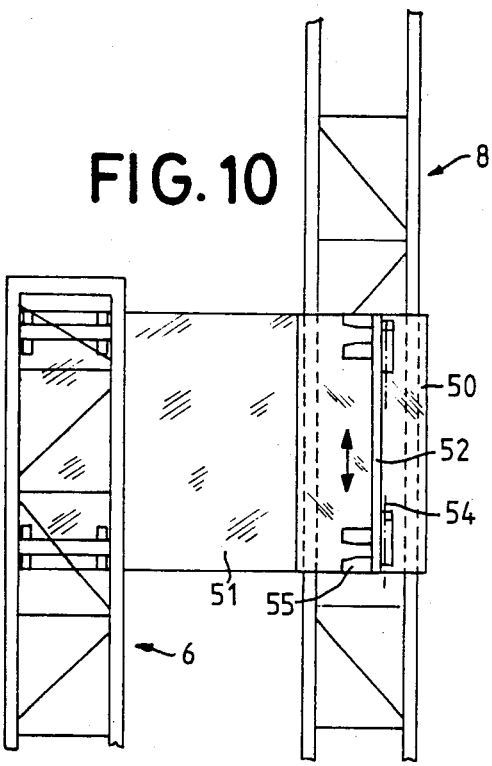
FIGS. 10 and 11 show a further embodiment of the support elements connecting the lift tower and the guide tower, in side elevation and in plan.
Figure 11:
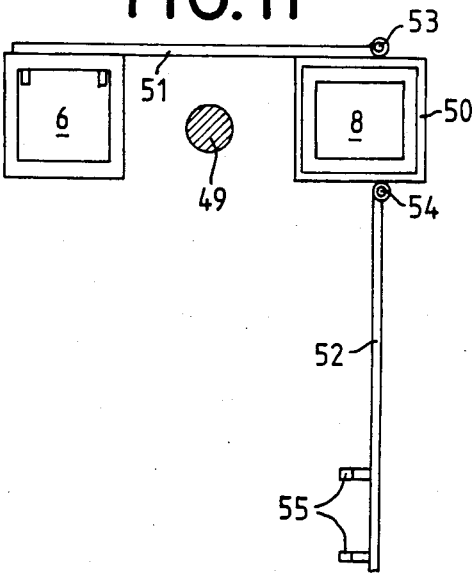

Lastly, another variant of such a construction is shown in FIGS. 10 and 11. Plates 51 and 52 are mounted pivotably about vertical axes 53 and 54 respectively on the left and on the right of the sliding sleeve, designated 50, of the guide tower. The plates may also be flat lattice structures in reality. Each plate carries four horizontally acting coupling parts 55, which grip the lift tower 6 laterally. The construction may be made such that one of the two plates 51 and 52 alone gives adequate support to the lift tower 6. For this purpose the coupling parts 55 must be equipped with appropriate locking devices, and steps must also be taken to ensure the anchorage of the respective supporting plate, the plate 51 in this example, on the guide tower 8. The particularly simple mode of operation is advantageous compared to the constructions hitherto described.

Figure 12:
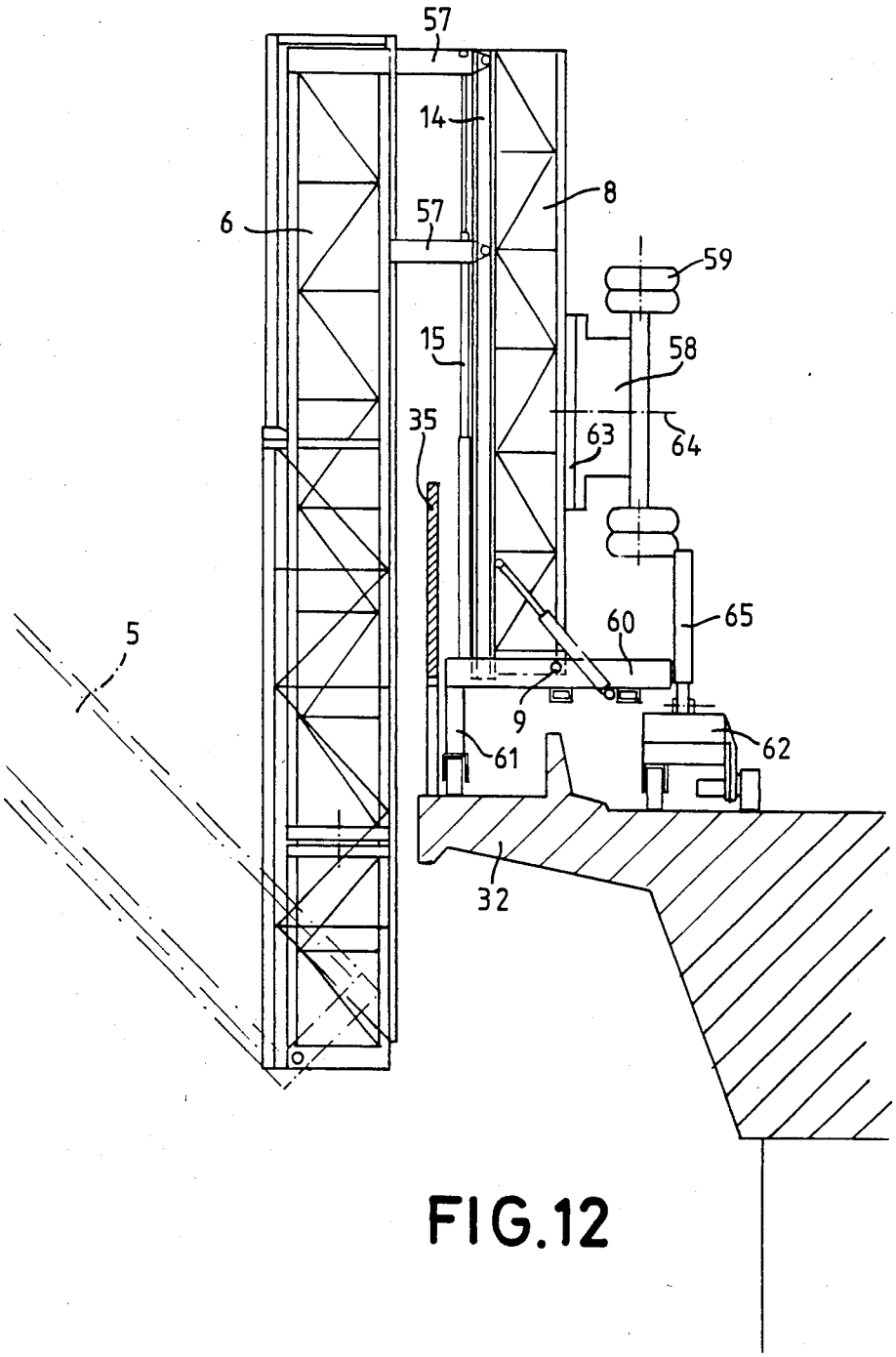
FIG. 12 shows another bridge bottom inspection apparatus in a semi-erected position, viewed in the longitudinal direction of the bridge.

FIG. 12 shows another bridge bottom inspection apparatus. It differs from and simplifies the examples so far described in that the lift tower 6 is guided by means of rigid guide arms 57 attached to it for up and down movement on the guide tower 8. An expensive truck as a transport vehicle is also dispensed with here. Instead of this, a simple two-axled trailer chassis 58, the twin wheels of which are designated 59, serves for road transport. For operation on the bridge a particular operating chassis is provided, consisting of a platform 60, a running stage 61 and a driving stage 62. The guide tower 8 is articulated by its horizontal axis 9 to the platform 60.

The special feature lies in the fact that a turntable 63, which is connected rotatably to the trailer chassis 58, is arranged on that side of the guide tower 8 remote from the lift tower 6, the axis of rotation 64 extending at right angles to the standing surface of the trailer chassis 58. The advantage of this bridge bottom inspection apparatus lies in the extremely narrow working base on the bridge, so that it is particularly suitable for extremely narrow bridges or for bridges with extreme traffic loads.

Starting from the operating position shown in FIG. 12, the dismantling of the apparatus into the transport position is described as follows: after folding the work platform 5, the towers are inclined to the right about the axis 9 and pivoted into the horizontal position. The twin wheels 59 then come into contact with the surface of the bridge. The weight of the apparatus now rests upon the turntable 63. The running stage 61 is now raised from the standing surface by pivoting the bracing wheels upwards, and the driving stage 62 is uncoupled from the lift cylinder 65 attached to the platform 60. The entire apparatus is now rotated on the turntable through 90° into the longitudinal direction of the bridge and direction of travel. The driving stage 62, which is now located beside the trailer chassis and between its two axles, is finally coupled to the lift cylinder 65 again in another position and is raised by the latter sufficiently not to interfere with the road transport. The apparatus may now be towed away by means of a tractor.

What I claim is:

1. An improved bridge bottom inspection apparatus with an operating chassis which stands on the bridge and which is movable adjacent a barrier along the edge of the bridge, with a raisable and lowerable lift tower which is operatively retained and supported by the chassis and which extends downwards past the edge of the bridge, and with a work platform which is attached to the lift tower and which is cantilevered beneath the bridge, wherein the improvement comprises: a guide tower (8) which is operatively supported by the chassis (1) and which is located on the inside of the edge barrier (34) of the bridge (32); and support means, overhanging the edge barrier, said support means having cantilevered members with free ends and cradle means at the free ends to releasably mount said lift tower (6) on the guide tower, the support means being movable upward and downward on the guide tower.

2. A bridge bottom inspection apparatus as claimed in claim 1, wherein the guide tower (8) is mounted on the operating chassis (60) pivotably about a horizontal axis (9), wherein the guide tower is movable to a horizontal transport position and has a predetermined side that is a lower side when the guide tower is in the horizontal transport position, and further comprising a transport chassis (58) having a support surface, and a turntable (63) connecting the predetermined side of the guide tower and the transport chassis (58), the turntable having an axis (64) which extends at right angles to the guide tower (8) and at right angles to the support surface of the transport chassis.

3. A bridge bottom inspection apparatus as claimed in claim 1, wherein the support means comprises a sliding stage (7) which is movable up and down on the guide tower, the cantilevered members being rigid support arms (10) which are attached to the sliding stage as first support elements for the lift tower, and further comprising two pivot arms (24) which are operatively connected to the chassis and which are pivotable about vertical axes (25) as second support elements for the lift tower, wherein the first support elements are selectively vertically engageable with and disengageable from the lift tower and the second support elements are also selectively vertically engageable with and disengageable from the lift tower.

4. A bridge bottom inspection apparatus as claimed in claim 1, wherein the support means comprises a sliding stage (40) which is movable up and down on the guide tower, the cantilevered members being three parallelogram frames which are mounted on the sliding stage and arranged as support elements for the lift tower, each frame being selectively engageable with and disengageable from the lift tower and including a plurality of respective arms (43, 44, 43′, 44′, 43″, 44″) arranged superposed and pivotable up and down, a respective vertically arranged articulated strap (45, 45′, 45″), and a respective pivoting drive unit (46) means for positioning the respective arms and strap.

5. A bridge bottom inspection apparatus as claimed in claim 1, wherein the support means comprises a sliding stage (50) movable up and down on the guide tower, the cantilevered members being two pivot frames (51, 52) mounted on the sliding stage as support elements for the lift tower, each frame alone being able to support the lift tower (6), the frames being mounted pivotably about vertical axes.

6. A bridge bottom inspection apparatus as claimed in claim 1, wherein the operating chassis comprises a transport vehicle (1) suitable for the long range transport of the entire bridge bottom inspection apparatus, and further comprising a turntable (3) which is mounted on the vehicle and which is rotatable about a vertical axis, the guide tower (8) being mounted pivotably, about a horizontal axis (9), on the turntable.

7. A bridge bottom inspection apparatus as claimed in claim 6, wherein the turntable is equipped with bracing rollers lowerable onto the bridge surface, the axes of the bracing rollers intersecting the pivot axis (9) of the guide tower (8) at right angles.

8. A bridge bottom inspection apparatus as claimed in claim 6, wherein the transport vehicle (1) has transverse jibs (29) provided with bracing rollers (31).

9. A bridge bottom inspection apparatus as claimed in claim 6, wherein the transport vehicle has front and back ends and a longitudinal axis running through the front and back ends, and wherein the turntable is arranged on a transverse carriage (39) movable horizontally relative to the transport vehicle and transversely to the longitudinal axis of the transport vehicle.

10. An improved bridge bottom inspection apparatus with an operating chassis which stands on the bridge and which is movable along the edge of the bridge, with a beam which is operatively retained and supported by the chassis and which extends downwards past the edge of the bridge, and with a work platform which is attached to the beam and which is cantilevered beneath the bridge, wherein the improvement comprises: a plurality of support elements disposed at spaced apart positions to operatively connect the beam to the operating chassis, the support elements being selectively and individually separable from the beam and retractable to the operating chassis, and a safety control device which selectively prevents all the support elements from simultaneously being separated from the beam.

11. A bridge bottom inspection apparatus as claimed in claim 10, further comprising a guide tower (8) which is operatively supported by the chassis (1) and which is located inward of the edge of the bridge; and support means, extending outward of the edge of the bridge, for supporting the lift tower (6) on the guide tower, the support means being movable upward and downward on the guide tower.

12. An apparatus for inspecting the bottom of a bridge having an edge and an upwardly extending barrier adjacent the edge, comprising:

a chassis which is movable along the edge of the bridge;

a turntable provided on the chassis so as to be rotatable about a vertical axis;

a guide tower having first and second ends, the first end of the guide tower being articulatedly connected to the turntable for pivoting movement about a horizontal axis, the guide tower having an operating position wherein it is disposed inward of the barrier and wherein its second end is elevated higher than its first end;

a lifting tower having a predetermined length;

means for mounting the lifting tower on the guide tower, the means projecting outward of the barrier when the guide tower is in its operating position and including cantilevered members with free ends having cradle means for releasably supporting the lifting tower so that the lifting tower extends downwardly beyond the edge of the bridge and is movable up and down the guide tower; and a working platform mounted on the lifting tower to cantilever beneath the bridge.

13. The apparatus of claim 12, wherein the means for mounting the lifting tower comprises a slide stage which is movable up and down on the guide tower, the cantilevered members being rigid support arms attached to the slide stage as first support elements for the lift tower, and further comprising two pivot arms which are mounted on the turntable and which are pivotable about vertical axes as second support elements for the lift tower, wherein the first support elements are selectively vertically engageable with and disengageable from the lift tower and the second support elements are also selectively vertically engageable with and disengageable from the lift tower.

14. The apparatus of claim 12, wherein the means for mounting the lift tower comprises a sliding stage which is movable up and down on the guide tower, the cantilevered members being three parallelogram frames which are arranged as support elements for the lift tower, each frame being selectively engageable with and disengageable from the lift tower and including a plurality of respective arms arranged superposed and pivotable up and down, a respective vertically arranged articulated strap, and a respective pivoting drive unit means for positioning the respective arms and strap.

15. The apparatus of claim 12, wherein the means for mounting the lift tower comprises a sliding stage movable up and down on the guide tower, the cantilevered members being two pivot frames as support elements for the lift tower, each frame alone being able to support the lift tower, the frames being mounted pivotably about vertical axes.

16. The apparatus of claim 12, wherein the chassis has transverse jibs provided with bracing rollers.

17. The apparatus of claim 12, wherein the chassis has front and back ends and a longitudinal axis running through the front and back ends, and wherein the turntable is arranged on a transverse carriage movable horizontally relative to the chassis and transversely to the longitudinal axis of the chassis.

* * * * *